US009980532B2

(12) United States Patent
Kazes

(10) Patent No.: US 9,980,532 B2
(45) Date of Patent: May 29, 2018

(54) PROPER POSTURE HIGH-HEELED SHOES

(71) Applicant: Hayim Vitali Kazes, Rishon Leziyon (IL)

(72) Inventor: Hayim Vitali Kazes, Rishon Leziyon (IL)

( * ) Notice: Subject to any disclaimer, the term of this patent is extended or adjusted under 35 U.S.C. 154(b) by 437 days.

(21) Appl. No.: 14/595,205

(22) Filed: Jan. 12, 2015

(65) Prior Publication Data

US 2015/0208757 A1 Jul. 30, 2015

Related U.S. Application Data

(60) Provisional application No. 61/925,748, filed on Jan. 10, 2014.

(51) Int. Cl.

| | |
|---|---|
| ***A43B 3/00*** | (2006.01) |
| ***A43B 7/14*** | (2006.01) |
| ***A43B 7/38*** | (2006.01) |
| ***A43B 21/24*** | (2006.01) |
| ***A43B 13/38*** | (2006.01) |
| ***A43B 17/00*** | (2006.01) |
| ***A43B 23/22*** | (2006.01) |

(52) U.S. Cl.

CPC ..... *A43B 7/141* (2013.01); *A43B 3/0057* (2013.01); *A43B 7/38* (2013.01); *A43B 13/38* (2013.01); *A43B 13/386* (2013.01); *A43B 17/00* (2013.01); *A43B 21/24* (2013.01); *A43B 23/22* (2013.01)

(58) Field of Classification Search

CPC ..... A43B 3/0057; A43B 7/141; A43B 7/38; A43B 21/24

USPC ..... 36/25 R, 34 R

See application file for complete search history.

(56) References Cited

U.S. PATENT DOCUMENTS

| | | | | |
|---|---|---|---|---|
| 4,003,146 | A * | 1/1977 | Meier | A43B 7/14 36/44 |
| 5,782,015 | A | 7/1998 | Dananberg | |
| 2004/0211086 | A1 | 10/2004 | Dananberg | |
| 2009/0193683 | A1 | 8/2009 | Igdari | |
| 2014/0123520 | A1* | 5/2014 | Tayar | A43B 13/38 36/103 |
| 2015/0013181 | A1* | 1/2015 | Cotter | A43B 7/141 36/24.5 |

FOREIGN PATENT DOCUMENTS

| | | |
|---|---|---|
| CN | 2259147 Y | 6/1997 |
| WO | WO 98/14083 | 4/1998 |

OTHER PUBLICATIONS

ISR and Written Opinion of PCT/US2015/011072.

* cited by examiner

*Primary Examiner* — Sharon M Prange

(74) *Attorney, Agent, or Firm* — Israel Nissenbaum; Yitzy Nissenbaum

(57) ABSTRACT

A high-heeled shoe for a human foot which enables a person wearing it to stand and walk in an anatomically correct (suitable) position, i.e. to walk just like when she walks with heelless flat shoes; enables the body to stand in balance and the foot to rest on all points. The high-heeled shoe is formed with a curving inclined supporting sole which extends into the heel with the curve being adjusted with arctangent values and a correction factor and toe and heel angles appropriate for a human foot to provide perfect conformity with the human foot for straight body posture suitable to anatomy.

10 Claims, 8 Drawing Sheets

PROPER POSTURE HIGH-HEELED SHOES

FIELD OF THE INVENTION

The present invention relates to high-heeled shoes and particularly to those which enable wearers to assume and maintain anatomically suitable postures while standing and walking.

BACKGROUND

Shoes and particularly those known as high-heeled shoes, generally exceeding two inches (5.08 cm), are adapted to be worn on a human foot. Though comfort is a primary consideration of footwear, it is often secondary to style, particularly with respect to the aforementioned high-heel shoes, which are most often specifically worn because of style considerations.

Anatomically, the human foot is comprised of twenty six different bones, which are connected to each other by approximately thirty joints and held in their respective places by ligaments and joint capsules. Thirty tendons, in addition to the lower muscles of the leg and the tendons of the foot muscles, have a role in foot movement.

The ankle joint is responsible for the dorsiflexion (raising the toes and standing only on the heels) and plantarflexion (lowering the toes and standing only on the toes) movements of the feet. Below the ankle joint, there are five bones called tarsal bones, and these bones may become a very resistant or rigid structure, when necessary, by movement as a group, depending on the nature of the surface, which they are in contact, via the joints there between. The tarsal bones are the five long bones, which are located at the front part of the foot. At the end of these tarsal bone structures, there are knuckles, which consist of phalanxes, required for normal walking. The toes are connected with the tarsal bones via metatarsophalangeal (MTP) joints with the most important one being the first MTP joint, belonging to the big toe.

A foot structure may be divided into three recognizable parts. Starting from the rear, a first part, i.e. the heel, is comprised of talus and calcaneus. The second or middle part is comprised of the navicular bone, metatarsal bones and other bones (cuboid bone and three cuneiform bones). Five toes comprise the third or front part of the foot. The big toe has two phalanxes just like the thumb of a hand and the other toes have three phalanxes. When a load is exerted on the toes, during a time when the big toe presses the ground, the other four toes assume a grabbing movement positioning.

There are two arch systems in the foot; one is the transverse arch at the front part of the foot. The second or other longitudinal arch starts from the calcaneus and follows the inner part of the foot until the base joint of the big toe. The arch at the front part is shaped by the ligaments, which maintain the form of the arch when no load acts on the foot and the stretches as it is pressed to the ground when a load is exerted on the foot. The plantar aponeurosis (arch ligament) that extends from the calcaneus to the toes also stretches. The more the load is exerted on the arch, the more the ligaments stretch. Many movements of the foot and the toes are controlled by the muscles which start from the lower part of the leg and whose tendons adhere to the foot.

Muscles control finer movements of the foot, which muscles begin and are adhered on the foot itself. Many movements of the foot are provided by the muscles at the bottom part of the leg, via ligaments. Standing, walking and running functions of the foot are made possible by contraction of these muscles. Many small muscles, apart from the above, produce a base at the sole of the foot with their positions between the bones.

It is evident from the very multiplicity of interactive components of the structure of a typical human foot that support and positioning of some components must be concomitantly related to support and positioning of other foot components in order to provide an interactive level of comfort. Extreme distortion of support and positioning of foot parts complicates the achievement of comfort.

It is known that the function of high-heeled women shoes used today is not health or comfort but is almost solely for appearance purposes of the shoe. Considerations of appearance are often at odds with proper foot support, particularly with foot movement. The situation arising from the incorrect degree calculation in nearly all of current high-heeled shoes primarily causes the center of gravity of the person wearing such shoes to shift towards the front part of the feet, i.e. towards the metatarsal bones. Thus, the walking with such shoes is in a deformed and unnatural manner. This may cause deformation of the Achilles tendon, pain in all parts of the body starting with the stretching of the tendons (including headache), meniscus, hip dislocation and may lead to the waist and neck, i.e. "Columna vertebralis" spine to assume an "S-shape" with spinal curvature greater than normal. Wearing such shoes all the time increases the S-shape of the spine, thereby increasing the possibility of the wearers suffering herniated discs and cervical disc hernias.

As is often the case when incorrect arc tangent values or incorrect heel-toe angle values are used in the high-heeled shoe structure, a person wearing the high-heeled shoes becomes uncomfortable and often, after a short period of time suffers a serious pain in the soles of the feet. Even when the angle of the heel is set at lower values than the minimum degree values, pain in the sole of the foot results because the center of gravity falls back more than necessary and the foot is forced to assume a greater arc than it is supposed to assume.

Various expedients have been used in the past, in various countries, with numerous different styles, in order to provide high-heeled shoes with anatomically correct support and increased comfort. However, there have been few, if any, of such expedients, which provide any high degree of proper support and comfort without affecting aesthetic appearances.

SUMMARY OF THE INVENTION

It is accordingly an objective of the present invention to provide a high-heeled shoe with minimal or no discernable appearance changes, yet which enables the person wearing it, usually a woman (though similarly applicable to men's footwear with reference hereinafter to female wearers) to stand and walk in an anatomically correct (suitable) position, i.e. to walk just like when she walks with heelless flat shoes.

Another objective of the present invention is to provide a high-heeled shoe, which enables the body of the wearer to stand in correct balance and the foot to rest on all points.

A further objective of the present invention is to provide a high-heeled shoe, which enables the wearer to assume and maintain anatomically suitable straight body posture with a high degree of comfort not normally obtainable with high-heeled shoe configurations particularly of the stylish type.

Generally, the present invention comprises high-heeled shoes of heel heights in excess of two inches (5.08 cm) configured with component elements in an inter-relational angular and length of proper configuration structure, wherein foot stress and discomfort is minimized while retaining aesthetic appearance thereof.

In accordance with the invention, anatomically suitable straight body posture and concomitant comfort can be achieved in high heeled shoes by adjusting the arctangent values, as described hereinafter, with substantially exact conformity. This can be made possible only by adjusting the center of gravity such that it will be on the rear or middle part of the foot. In other words, straight body posture can be achieved by bringing the body to a position suitable to a healthy anatomy.

Foot support in high-heel shoe construction and components involved therewith entails understanding and definition of the parts thereof. A first part, which is normally in contact with the bottom of the foot is the "Insole Board". This is a firm part of the shoe that is directly under the entire back part of the foot in most footwear. It usually starts from the back portion of the shoe (heel section) and often extends until either the toe section or until the end of the curvature of the bottom of the foot. The insole board usually has another layer of cushion and/or a layer of insole lining on top of it. This thickness of the lining may and often does vary.

The "Shank" is a support (often metal such as steel, or it can be made of fiberglass or other strong materials) that is placed at some point under the insole board to support the shape of the insole board and the weight that is placed on the insole by the wearer. It has no fixed placement position; but its curve needs to match the curve of the insole board at the position that it is placed under (or sometimes over) the insole board. As used herein the "curvature" is normally that of the "insole board", or anything else in the shoe that is directly under the wearer's foot and which starts from the back of the foot and extends forward till it reaches the point of no further descent (i.e., essentially plateaus). In this latter regard it is noted that the insole board usually has another layer of cushion and/or a layer of insole lining on top of that. The thickness of the lining may vary and thus affect parameters of curvature. In instances where there is a meaningful thickness and due to the firmness of the cushion material the foot rests on a curvature other than the insole plane, then the curvature as specified herein is one that is attained when the wearer places her/his weight on the shoe and the shape that remains directly under his foot after repeated wearings of the shoe (after the cushioning has settled after some initial use, or in case of strong cushioning that retains its shape—at the first wearing) is the "curvature" as used herein.

When the angles (arctangent values) of the insole board in a high-heeled shoe, are adjusted in conformity with anatomy, each and every point of the protrusions and grooves on the sole of the feet exactly rests on the insole board. Since various shoe parts may directly support a wearer's foot, the term "insole board", as used herein, refers specifically to the portion of the shoe and curvature thereof, which directly supports and is in contact with the wearer's foot. It also includes the same type of upper structure in a wedge type high-heeled shoe.

The insole board of a high-heeled shoe generally follows a shape similar to an arctan (k*x) function.

In order to obtain the shape of the functions in this structure and how they exhibit the desired curvature, "Equation 1" was initially used to obtain a y value for the points on the insole board with a desired curvature:

$$y=(5/\arctan(10k))\arctan(kx) \qquad \text{(Equation 1)}$$

wherein, with an x-y coordinate plane being superimposed relative to the lateral position of the high heel shoe insole board with a vertex at the initial point of upward inclination of the insole board, the x coordinate value denotes the length which extends from the vertical part of the coordinate plane to the point where the insole board is positioned. The value of k is empirically determined and as determined, varies in accordance with heel height with various values being set forth in Table 4 below (with extrapolation and variations thereof being determined for other heel heights and operable ranges for the specific heel heights).

The $k_2$ factor (as used in a correction factor set forth below) denotes, for a curvature factor, a constant value of 300, obtained as a result of experimental studies in determining anatomically correct position and maximum comfort in accordance with the present invention. The y coordinate value denotes the length, which extends from the horizontal part of the coordinate plane to the point where the insole board is positioned.

The x and y values given in the equations are each a value of length, with the y value varying in accordance with the change of x distance along the insole board position.

A desired insole board curvature K derived from the y value of equation 1 was computed by using "equation 2".

$$K=y''/(1+(y')^2)^{3/2} \qquad \text{(Equation 2)}$$

wherein K denotes a value that changes with respect to the first derivative of y (y') and the second derivative of y (y") given in equation 2.

The form of equation 2 for the K value expressed in terms of values for x and the constant k is shown as "equation 3" which equation is used for the determined curvature.

$$K=\frac{-2k^3x\cdot(5/\arctan(10k))\cdot(1+k^2x^2)^{-2}}{[1+k^2\cdot(5/\arctan(10k))^2\cdot(1+k^2x^2)^{-2}]^{-(3/2)}} \qquad \text{(Equation 3)}$$

The high-heeled shoe configuration relative to heel and platform height of a particular high-heeled shoe, which enables anatomically suitable body posture and walking, and has orthopedic inclination and high heels in accordance with the present invention, comprises the elements and parameters of:

- at least one insole board, which is configured such that a toe angle of the shoe (β) and concomitantly the heel angle (a) provides the correct straight body posture and, which is sized with the curvature K, as obtained as a result of multiplication of y=(5/arctan(10k))·arctan (k·x) with a correction coefficient $1/(1+(x-x_j)2/k_2)$ relating to the actual configuration of a human foot and is calculated with the factors of x (and concomitant y values) by taking any insole board distance x value from zero to one hundred, and the height of a heel which can be varied, as desired, by a selected height ranging from about 2-4.5 inches of height differential (with possible variation of end points of up to 10%) between the front of the foot to the heel of the person (and up to 8 inches with a front platform up to about 3½ inches to maintain the about 4.5 inch maximum differential),
- at least one front platform which is formed to raise the foot above the ground by a selected height, and
- at least one toe which is located at the place where the tip of the foot is placed and whose angle can be changed by a desired amount between about 7° to 26° (with a possible 10% deviation).

The above and other objectives, features, advantages of the present invention will become more apparent from the following discussion and drawings in which:

SHORT DESCRIPTION OF THE DRAWINGS

DETAILED DESCRIPTION

Figure 1:
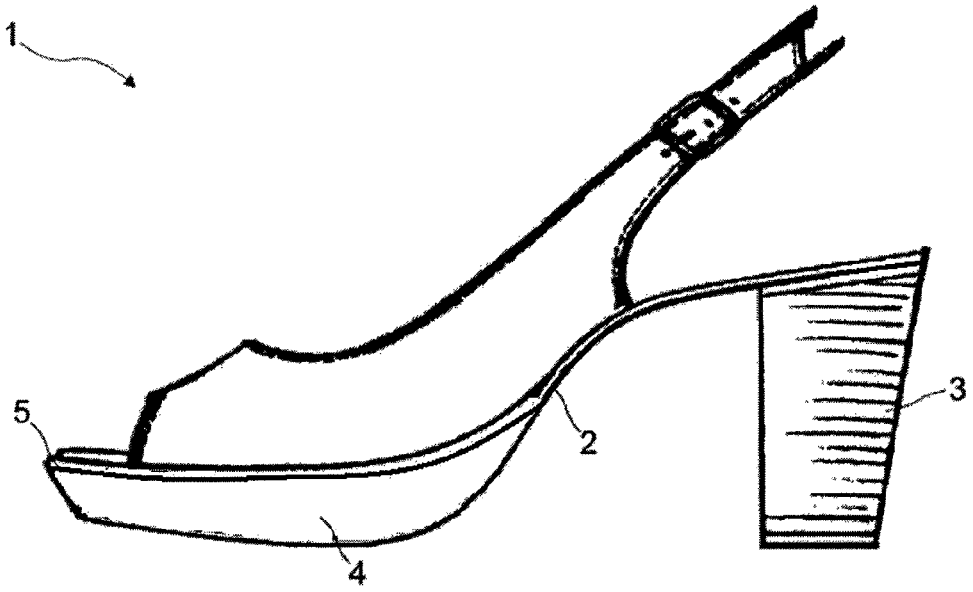
FIG. 1 is a side view of a high-heeled shoe depicting areas of modification affecting posture and comfort levels.

The components shown in the figures are each given the common component reference numbers as follows:

1. High heeled shoe
2. Insole board as measured from the point at which the insole board in contact with the foot rises and extending to the back or rear of the shoe.
3. Heel as part of the insole board and supporting the rear or heel of the wearer
4. Front platform extending forward from the rising point of the insole board
5. Toe as the front of the shoe Table 1 provides the sole alignments where the proper "curvature" is realized and is computed by using the "equation":

$$K=4/i \quad \text{(Equation 4)}$$

whereby i is K, given in Equation 2, divided by 4.

Table 1 shows the sole alignments (x values) where the greatest "curvature" takes place by using equation 4 is as follows:

TABLE 1

| | i | | | | | | | | | |
|---|---|---|---|---|---|---|---|---|---|---|
| | 1 | 2 | 3 | 4 | 5 | 6 | 7 | 8 | 9 | 10 |
| x | 0.88 | 1.22 | 1.47 | 1.68 | 1.86 | 2.02 | 2.18 | 2.32 | 2.46 | 2.59 |
| | i | | | | | | | | | |
| | 11 | 12 | 13 | 14 | 15 | 16 | 17 | 18 | 19 | 20 |
| x | 2.73 | 2.86 | 3.00 | 3.13 | 3.27 | 3.41 | 3.55 | 3.68 | 3.82 | 3.97 |

In the light of these data, it is appears that in order to reach the alignment where the greatest bending takes place when k is decreasing, k should be minimized. When the obtained figure is examined, it is observed that the insole (2) angle and the heel (3) angle increase more than expected as k value decreases. A factor function is required in order to shift the bending alignment backwards without increasing the heel (3) angle very much.

EXAMPLES

Ten different sole trials are made by calculation, with heels of varying heights ranging from 2" to 4" (5.08 to 10.16 cm) to obtain sole or insole board curvatures complying with "equation 1" and the correction coefficient, with the ideal forms of the $A_1$, $A_2$, $A_3$, $A_4$, $A_5$, $A_6$ insole boards for use with heels of 2", 2½", 3", 3½" and 4", 4.5" being obtained (or derived). The suitable correction factor used with equation 1 is the below given "equation 5" as calculated using parameters of the MatLab software program.

$$1/(1+(x-x_j)2/k_2), x\in[0,100] \quad \text{(Equation 5)}$$

wherein the variable x, for the heel sizes of $A_1$, $A_2$, $A_3$, $A_4$, $A_5$, $A_6$ are given in Table 4 below, with:

$x_j$ being the variable used for changing the effect of the factor function in the formula so that the insole board is more suitable to the human foot anatomy. And variable $k_2$ is the variable used for changing the effect of the factor function in the formula so that the insole board is more suitable to the human foot anatomy and which has been determined to be 300.

With the corrected formula that is obtained, the $A_2$, $A_3$, $A_4$, $A_5$, and $A_6$ insole boards, are formed and these models are observed experimentally (as direct foot supports) and are seen to be successful in providing both anatomically correct support and increased comfort for the wearers.

Table 2 shows that $A_1$, $A_2$, $A_3$, $A_4$, $A_5$, and $A_6$ inboard soles can be produced in high heeled shoes without front platforms, with a height ranging from about 2" to 4.5" and as high heeled shoes, with appropriately sized front platforms with a height ranging from about 0" to 3.5" provided that the elevation distance between the front of the foot wearing the shoe to the heel is no more than about 4.5", i.e. with appropriate platforms ranging from 0 to 3.5" for the aforementioned heels.

Figure 7:
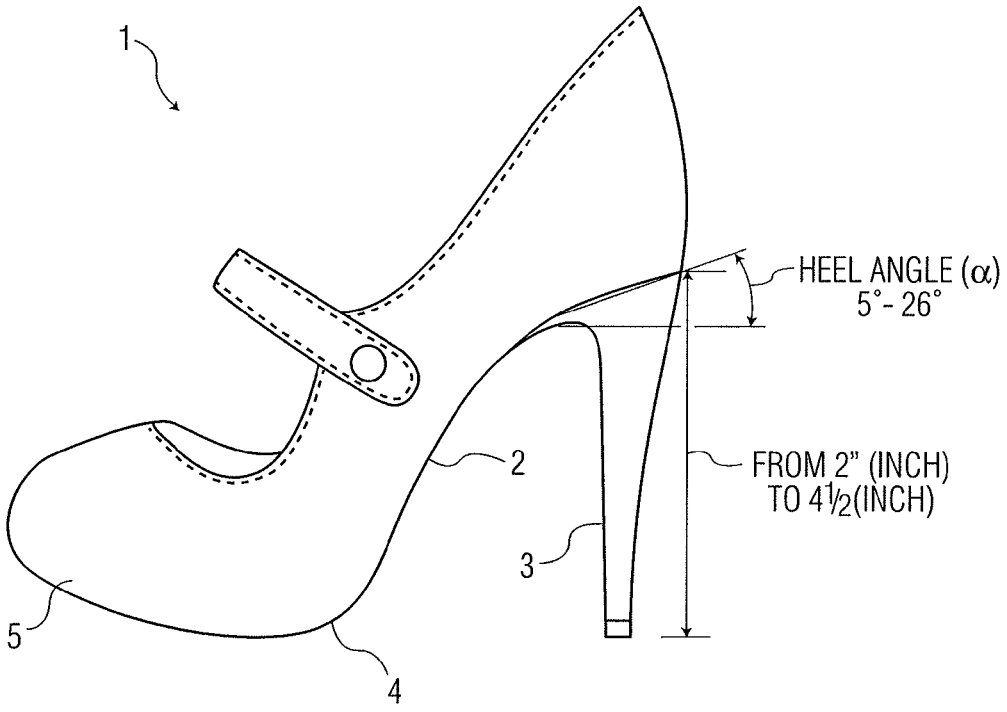
FIG. 7 is a left side view of a high-heeled shoe of the invention showing heel angles (α) and heel support configurations, as shown in FIG. 2, for a shoe with a heel ranging from about 2-4.5 inches.

The high heeled shoe's (1) toe angles (β) and heel angles (α) shown in the Figures vary relative to the insole board (2) so as to ensure a straight body posture. The heel angle (α) corresponding to the toe angle (β) of each high-heeled shoe (1) is given in Table 2. As seen in Table 2, shoe heels that range from 2 inches to about 8 inches preferably have (α) heel angle values in the range of about 5° to 26° (with a 10% possible deviation) as shown in FIG. 7. The variation of heel angles is a function of one or two factors. The first one being the difference of the varying heel heights (cm/inch), and the second being the differences exhibited by the materials used in manufacturing the high heeled shoe such as the lasting process. The best results (posture and comfort) are obtained when the toe angle (β) of the high-heeled shoe (1) is at angles varying between 7° and 26°. The heel angle (α) is a function of insole board curvature calculation with the heel being the rear terminus thereof but with variations thereof, in the given range, being functionally determined by the manufacturing process.

Generally, a typical heel section distance ranges between 35 to 50 mm from the rear of the shoe with a heel angle being measured therefrom such as with wedge shoes and may be smaller with respect to very narrow stilletto heels. Calculations of heel angles and ranges thereof as made herein are generally determined with a length of between 35 to 50 mm from the rear of the shoe along the foot support.

The distances provided for the following Table 2 for the insole boards with heel heights, as indicated for $A_1$-$A_6$, begin at the rear of the shoe and end of the insole board and extend along the length of the insole board.

comfort levels, at their outer limits, are defined by the values for adjacent heel heights in the table. Thus, for example, at the 90-100 mm distance point the degree curve value for $A_1$ can range from 42.96° to the 45.63° of $A_2$. For $A_2$ the value ranges from 42.96° of $A_1$ to the 49.61° of $A_3$ from the values of $A_1$ to $A_3$. Similarly for $A_3$ the value ranges from the 45.63° of $A_2$ to the 51.72° of $A_4$ and for $A_4$ the value ranges from the 49.61° of $A_3$ to the 56.13° of $A_5$. The range for $A_5$ is from the 51.72° of $A_4$ to the 58.43° of $A_6$. The value for $A_6$ is from the 56.13° of $A_5$ to the 58.43° of $A_6$. The values for $A_1$ and $A_6$ are respective minimums and maximums with possible deviation. The range is extended similarly over the various distance points.

In an analogous manner the heel angles α may vary in the ranges between adjacent heel heights $A_1$ to $A_6$ as given in the table for the specific heel heights with heels angles for $A_1$ being between 5°-16°, for $A_2$ being between 5°-18°, for $A_3$ being between 12°-20°, for $A_4$ being between 14°-22°, for $A_5$ being between 16°-26°, and for $A_6$ being between 18°-26° with the values for $A_1$ and $A_6$ being respective minimums and maximums (with possible deviations of up to 10%).

Determination of curve angles at specific positions and curve values for operable ranges for heel heights which fall within to 2"-4.5" range and different from the specific $A_1$ to $A_6$ heights, the $x_j$ and k values of Table 4 are used to provide the extrapolation of range values between the adjacent $A_1$ to $A_6$ values.

Accordingly, modeling can be effectively applied to many different insole boards by using the formula for intermediate heel height values, by interpolating with use of the values of the $A_1$-$A_6$ model insole boards in the Tables 2 and 3. Insole boards made with the intermediate heel heights are accept-

TABLE 2

| | Distance Along the Insole Board from Rear of Shoe | | | | | | | | | | | |
|---|---|---|---|---|---|---|---|---|---|---|---|---|
| Heel Height | 90-100 mm | 80-90 mm | 70-80 mm | 60-70 mm | 50-60 mm | 40-50 mm | 30-40 mm | 20-30 mm | 10-20 mm | 0-10 mm | Heel Angle (α) | Toe Angle (β) |
| $A_1$ (2") | 42.96° | 41.97° | 38.66° | 33.89° | 28.43° | 22.83° | 17.41° | 12.36° | 7.78° | 3.75° | 5°-9° | 7°-26° |
| $A_2$ (2½") | 45.63° | 44.02° | 39.84° | 34.11° | 27.75° | 21.42° | 15.49° | 10.17° | 5.53° | 1.59° | 12°-16° | 7°-26° |
| $A_3$ (3") | 49.61° | 46.92° | 41.20° | 33.86° | 26.16° | 18.93° | 12.54° | 7.10° | 2.60° | 0.27° | 14°-18° | 7°-26° |
| $A_4$ (3½") | 51.72° | 48.40° | 41.77° | 33.51° | 25.11° | 17.46° | 10.91° | 5.50° | 1.14° | 0.00° | 16°-20° | 7°-26° |
| $A_5$ (4") | 56.13° | 51.32° | 42.52° | 32.18° | 22.35° | 14.03° | 7.38° | 2.20° | 0.00° | 0.00° | 18°-22° | 7°-26° |
| $A_6$ (4½") | 58.43° | 52.74° | 42.63° | 31.10° | 20.60° | 12.07° | 5.48° | 0.51° | 0.00° | 0.00° | 22°-26° | 7°-26° |

It is understood that insole board models obtained by the aforementioned formula 1 with correction factor, as described are suitable for proper posture and comfort though there may be deviation of a few degrees for either the toe angles (β) and heel angles (α) within the aforementioned range parameters. Ranges of deviation with deviations in able from a proper posture comfort consideration. Insole boards made with the intermediate values can be used in the production of successful shoes similarly without being affected by deviations of few degrees. The intermediate values of the A values are provided in the below given Table 3.

TABLE 3

| | Distance Along the Insole Board from Rear of Shoe | | | | | | | | | |
|---|---|---|---|---|---|---|---|---|---|---|
| Heel Height | 90-100 mm | 80-90 mm | 70-80 mm | 60-70 mm | 50-60 mm | 40-50 mm | 30-40 mm | 20-30 mm | 10-20 mm | 0-10 mm |
| $A_1$ (2")- | 42.96°- | 41.97°- | 38.66°- | 33.89°- | 28.43°- | 22.83°- | 17.41°- | 12.36°- | 7.78°- | 3.75°- |
| $A_2$(2½") | 45.63° | 44.02° | 39.84° | 34.11° | 27.75° | 21.42° | 15.49° | 10.17° | 5.53° | 1.59° |
| $A_2$(2½")- | 45.63°- | 44.02°- | 39.84°- | 34.11°- | 27.75°- | 21.42°- | 15.49°- | 10.17°- | 5.53°- | 1.59°- |
| $A_3$ (3") | 49.61° | 46.92° | 41.20° | 33.86° | 26.16° | 18.93° | 12.54° | 7.10° | 2.60° | 0.27° |
| $A_3$ (3")- | 49.61°- | 46.92°- | 41.20°- | 33.86°- | 26.16°- | 18.93°- | 12.54°- | 7.10°- | 2.60°- | 0.27°- |
| $A_4$(3½") | 51.72° | 48.40° | 41.77° | 33.51° | 25.11° | 17.46° | 10.91° | 5.50° | 1.14° | 0.00° |
| $A_4$(3½")- | 51.72°- | 48.40°- | 41.77°- | 33.51°- | 25.11°- | 17.46°- | 10.91°- | 5.50°- | 1.14°- | 0.00°- |

TABLE 3-continued

| Heel Height | Distance Along the Insole Board from Rear of Shoe | | | | | | | | | |
|---|---|---|---|---|---|---|---|---|---|---|
| | 90-100 mm | 80-90 mm | 70-80 mm | 60-70 mm | 50-60 mm | 40-50 mm | 30-40 mm | 20-30 mm | 10-20 mm | 0-10 mm |
| $A_5$ (4") | 56.13° | 51.32° | 42.52° | 32.18° | 22.35° | 14.03° | 7.38° | 2.20° | 0.00° | 0.00° |
| $A_5$(4")-$A_6$(4½") | 56.13°-58.43° | 51.32°-52.74° | 42.52°-42.63° | 32.18°-31.10° | 22.35°-20.60° | 14.03°-12.07° | 7.38°-5.48° | 2.20°-0.51° | 0.00° | 0.00° |

When the $A_1$, $A_2$, $A_3$, $A_4$, $A_5$, $A_6$ insole boards are being formed, the variables $x_j$, k and $k_2$ given in Table 4, are used as described above, with k being a variable function of the MatLab algorithm. $k_2$ given in this table is the variable used for changing the effect of the factor function in the formula so that the insole board is more suitable to foot anatomy and which has been empirically determined to be 300.

TABLE 4

| | $x_j$ | k | $k_2$ |
|---|---|---|---|
| $A_1$ | 60 | 1/4.5 | 300 |
| $A_2$ | 50 | 1/4.25 | |
| $A_3$ | 40 | 1/3.75 | |
| $A_4$ | 35 | 1/3.5 | |
| $A_5$ | 25 | 1/3 | |
| $A_6$ | 20 | 1/2.75 | |

Figure 2:
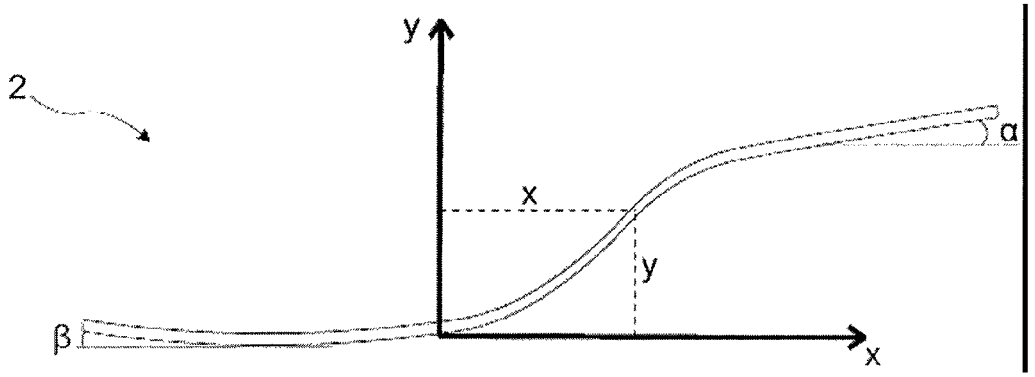
FIG. 2 is a side view of the insole board of the high-heeled shoe of FIG. 1 indicating angles of modification and x-y components of angular gradients of the insole board elevation.
Figure 3:
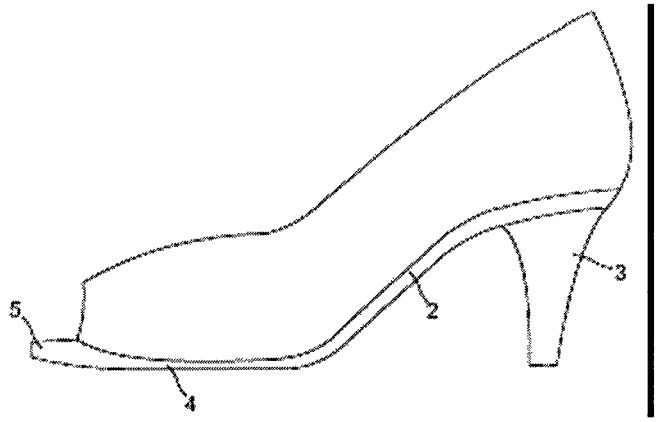
FIG. 3 is the side view of another embodiment of the high-heeled shoe of FIG. 1, with a reduced width heel.

With reference to the drawings, as shown in FIGS. 1 and 3, typical high-heeled shoes 1 comprise a toe section 5, a sole or platform section 4 which can provide an elevated rest for the front of the foot, as shown in FIG. 1, or may be of minimal thickness as shown in FIG. 3. The insole board or direct foot support section 2 extends from and is usually integrated with sole or platform section 2 and begins at the elevation point shown, for insole board 2 in FIG. 2. The insole board 2 rises, usually as a curved section toward the rear or heel of the shoe where a portion thereof is supported by heel 3, shown in different configurations in FIGS. 1 and 3. The heel of a wearer of the shoe 1, shown in FIGS. 8A and 8B rests on and is supported by heel 3 in both the prior art shoe of FIG. 8A and that of the present invention of FIG. 8B. The heel angle (α) of the shoes of the present invention, shown in FIG. 2 and FIG. 7, are at relatively low levels of 5-26°, generally considerably below those of heel angles in high-heeled shoe of the prior art. Though toe angles can be flush with the ground, such as with the shoe of FIG. 1, for better posture and increased comfort, the front toe angle (β) should be slightly elevated with an angle ranging from 7° to 26° with little or no variation from this range.

Figure 4:
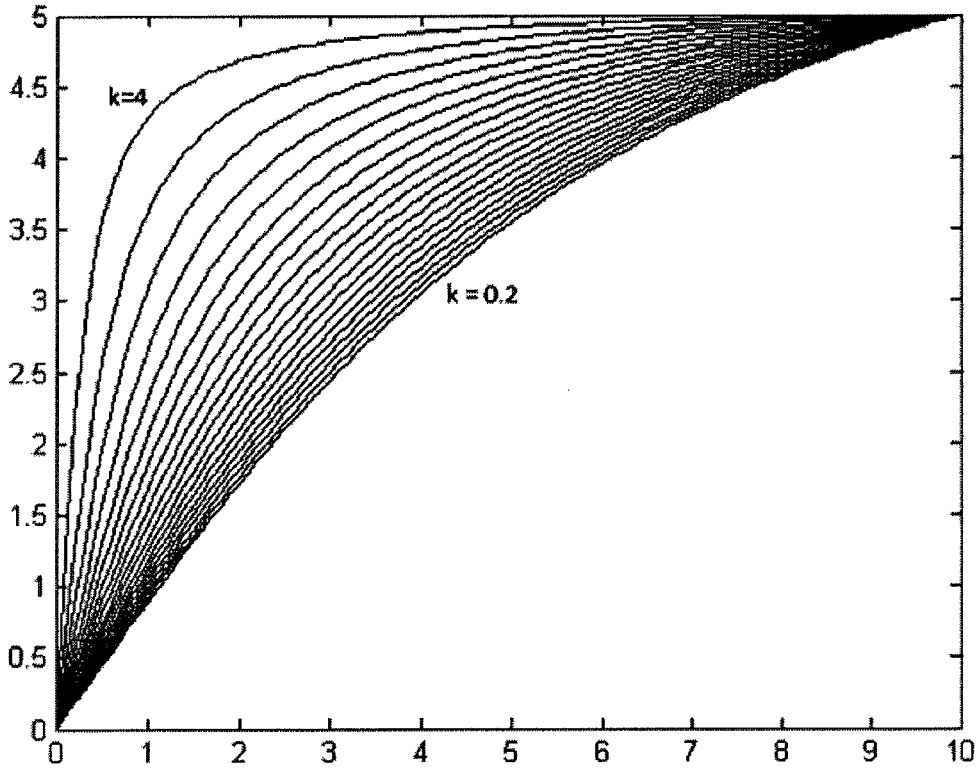
FIG. 4 is the graphical representation of the route followed by the function y depending on the change of k in function y=(5/arctan(10k))*arctan(k*x) originally used in determining comfort level modifications based on variations in the x, y components of FIG. 2.

The curve of the insole board 2 of both prior art shoes and that of the present invention is defined by an x, y axis coordinate system superimposed on the insole board with a point of origin at the point of the insole board 2 where the insole board begins to rise as shown in FIG. 2. Each point on the insole board is defined by the interrelated x and y parameter values. The curvature of the insole board is determined by a function k, as shown in FIG. 4 which can range from limited curvature with low k values to highly curved shapes with the various curvatures providing different degrees of support and or comfort/discomfort and proper foot and positioning and posture.

Figure 5:
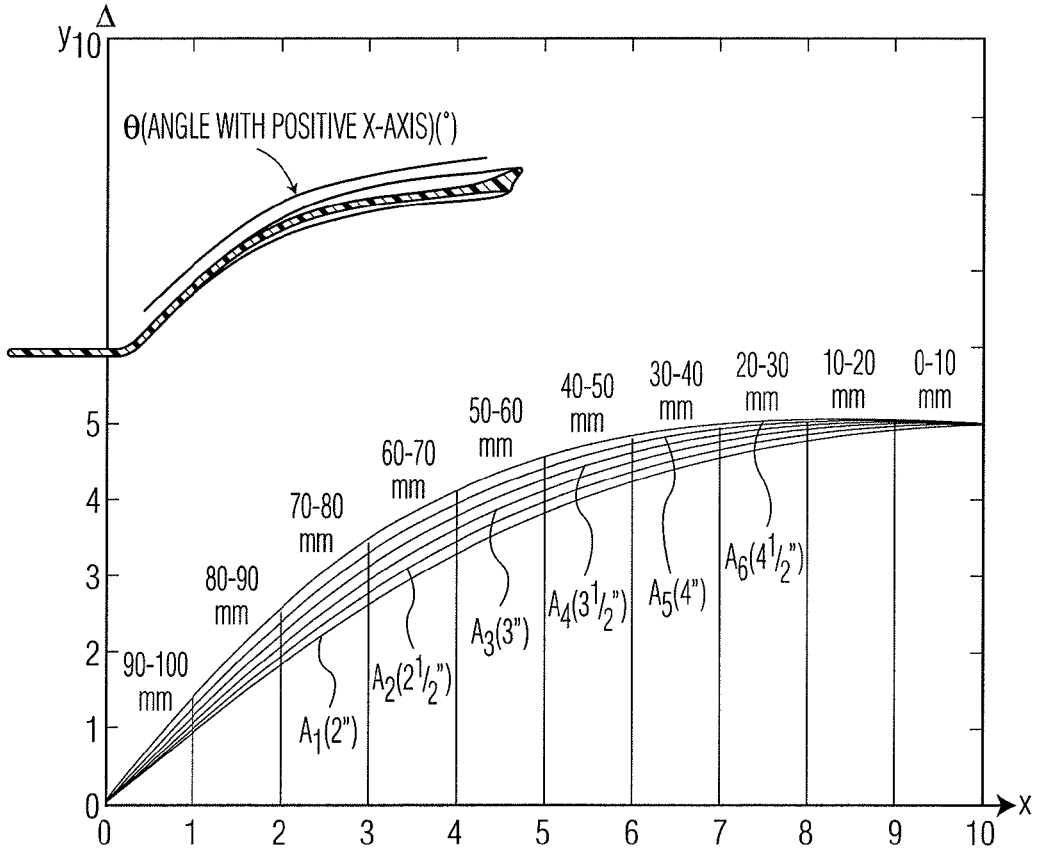
FIG. 5 is a graphical representation of the curvature change of the $A_1$, $A_2$, $A_3$, $A_4$, $A_5$, $A_6$ insole boards of high-heeled shoes of different heel heights (representing hereinafter heel heights of 2", 2½", 3", 3½", 4" and 4.5" respectively), which can be produced with different curvatures with respect to x and y axes at different points of the insole board curve.
Figure 6:
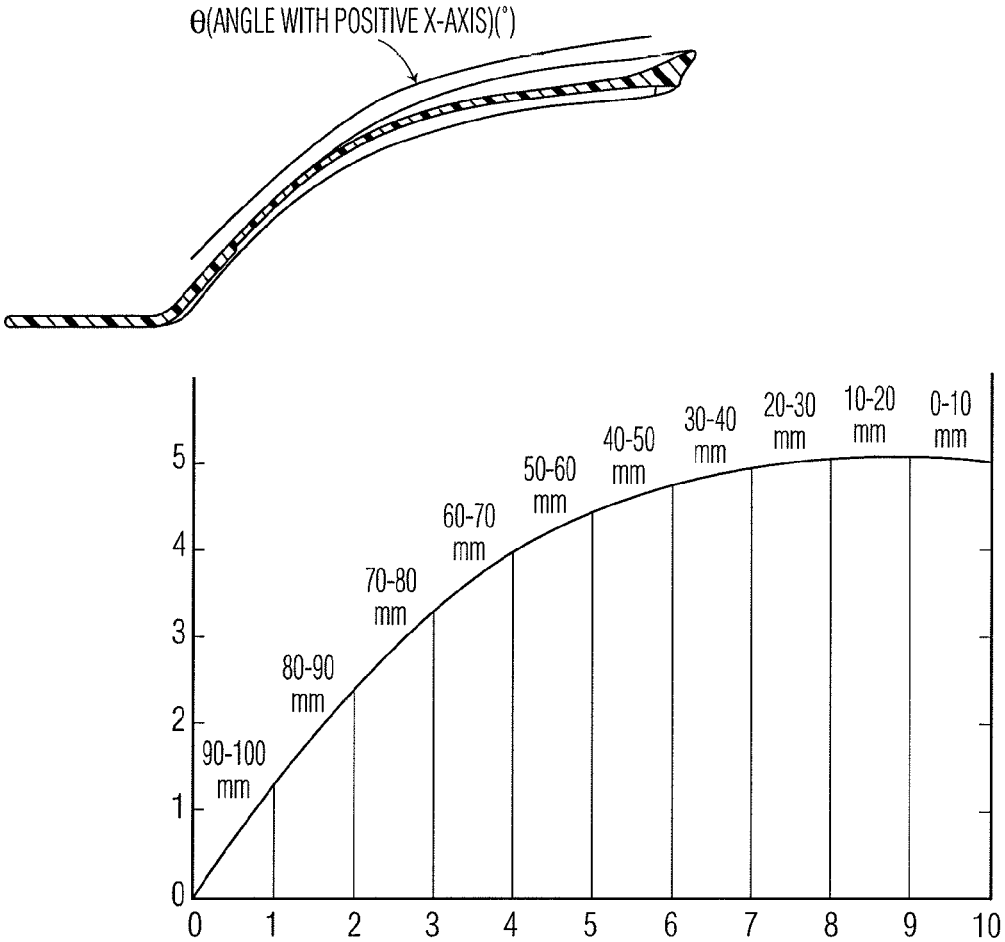
FIG. 6 is an insole board and a graphical representation of the insole board, which provides the x-y inclination parameter in accordance with the present invention for a 4 inch heel.

As shown in the x-y graph of FIG. 5, five insole boards, $A_1$-$A_5$ are made in accordance with the present invention with utilization of equation 1, as corrected with the correction factor of equation 5, for every x, y value of the curve and with a $k_2$ constant value being 300 and as represented by different curves. The $A_1$-$A_6$ insole boards were made for heel heights of 2", 2½", 3", 3½", 4" and 4.5" respectively. FIG. 6 depicts in detail the curve for the $A_5$ insole board with a 4" heel.

Figure 8A:
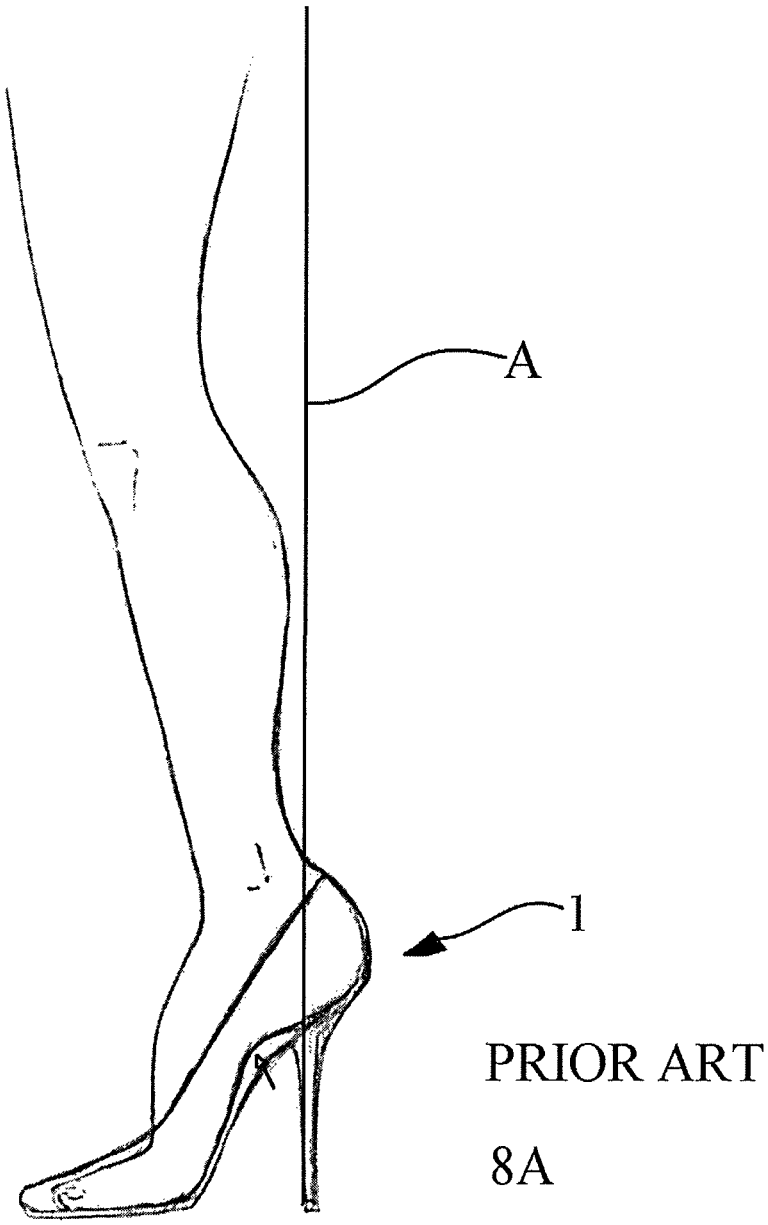
FIGS. 8A and 8B depict the differences in position of a human leg while wearing a high heeled shoe of the prior art (8A) and the present invention (8B)
Figure 8B:
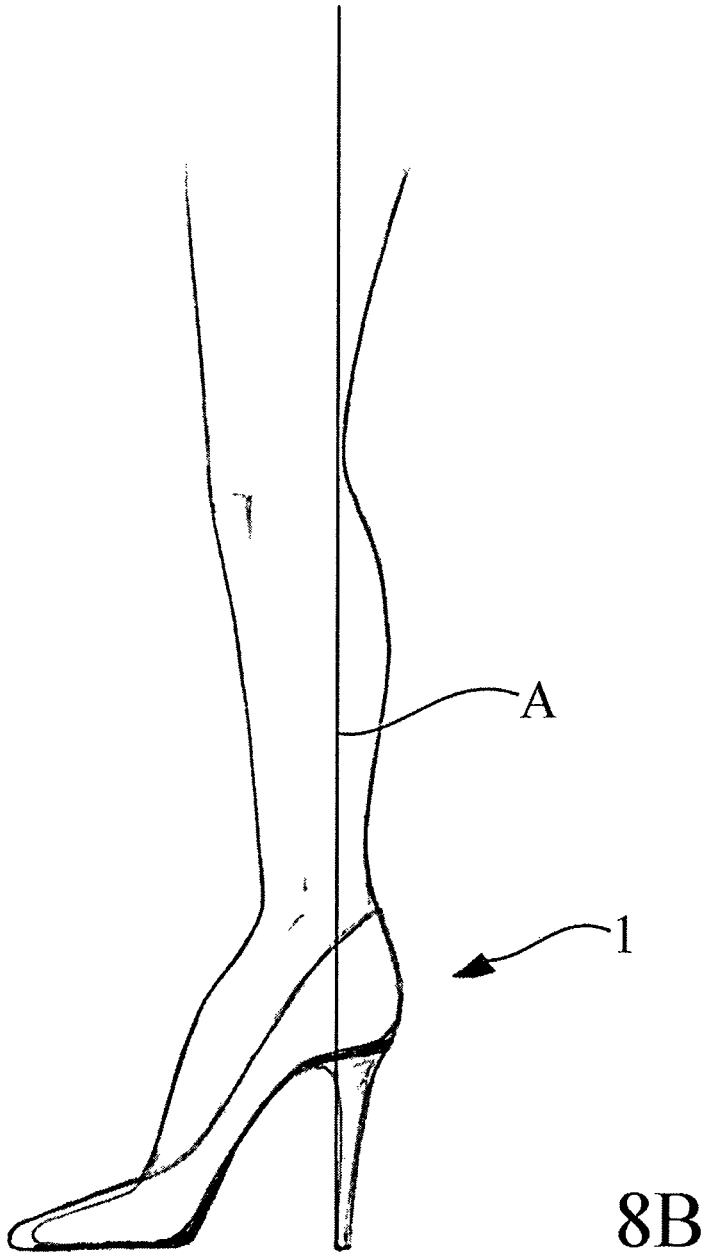

FIGS. 8A and 8B show the position and posture bearing of a wearer of a prior art shoe 1' (FIG. 8A) and a shoe of the present invention 1 (FIG. 8B) wherein the proper upright axis A for the prior art shoe wearer shows a front leaning deviation from a proper posture, a lack of full support and a resultant forward toe pressure engendering typical high heel shoe pain. There is also a lack of support in the arch area 9. In contrast the shoe 1 in FIG. 8B provides full support throughout the arch and with the heel being fully support such that the wearer is erect along axis A with a more aesthetic and statuesque appearance, with the shows of FIGS. 8A and 8B showing very little discernible difference in stylish appearance.

Figure 9:
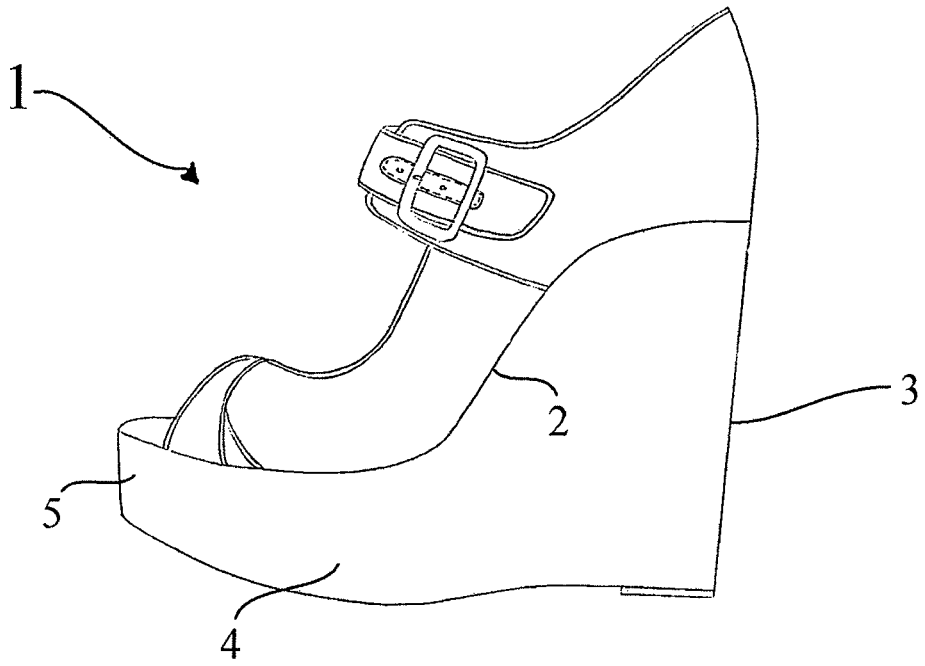
FIG. 9 shows a wedge type embodiment of a high-heeled shoe in which the parameters of the present invention of appropriate sole curvature have been embodied.

FIG. 9 shows a high-heeled shoe embodiment known as a wedge shoe wherein a fully supported sole is used in place of a steel insole board as used in the other embodiments. The curvature of sole 2 is substantially identical to that of the embodiments with the insole board.

It is understood that the above disclosure and examples are merely exemplary of the present invention and that changes in materials, structures, configurations and the like such as additional cushioning at pressure or normal pain sites on the shoe insole especially at or near the heel are possible without departing from the scope of the present invention as defined by the following claims.

What is claimed is:

1. A high-heeled shoe for a human foot which enables a human to assume and maintain anatomically suitable body posture for standing and walking, the high-heeled shoe comprising a toe section and a heel section separated by and connected with a sole section, the high-heeled shoe being configured for the respective support of a toe, heel and sole of a human foot wherein a vertical distance between support of the toe and support of the heel is between two to four and a half inches and wherein the sole section which is adapted to directly support a human sole and heel comprises a curved inclination, as superimposed on an x-y coordinate system having a point of origin at the point at which the sole section begins to rise from a base of the toe section, wherein the curved inclination configuration is determined according to values of x and y along the sole section according to the formula:

$$y=(5/\arctan(10k)).\arctan(k.x)$$

wherein y is the y coordinate of a point on the sole section, x is the x coordinate of the point and k is an empirical value ranging between 1/4.5 and 1/2.75, with the y value indicating the vertical distance from a plane extending from the base of the toe section, and wherein the y value is multiplied by a human foot correction factor formula of:

$$1/(1+(x-x_j)2/k_2)$$

to obtain the curvature K at each point on the sole section, wherein x is the x coordinate, $k_2$ is 300 and $x_j$ is a function of the vertical distance between toe section and heel section and ranges from 20 to 60 for vertical distances ranging between 2 and 4.5 inches, wherein values of $x_j$, for vertical distances of 2", 2.5", 3.0", 3.5", 4.0" and 4.5", are 60, 50, 40, 35, 25 and 20 respectively.

2. The high-heeled shoe of claim 1, wherein the sole section and heel section are comprised of a continuous curved sole.

3. The high-heeled shoe of claim 2, wherein the toe section comprises an inclination β rising from the base of toe section at an angle between 7° to 26°.

4. The high-heeled shoe of claim 2, wherein the heel section comprises an inclination α rising from a base of the heel section at an angle between 5° to 26° and selected to provide a substantially straight body posture.

5. The high-heeled shoe of claim 1, wherein the toe section is elevated from a base section of the high-heeled shoe with a platform up to 3½ inches in height.

6. The high-heeled shoe of claim 1, wherein the toe section, sole section and heel section are configured as a solid wedge with an upper part of the wedge providing direct support for the toe, sole and heel of the human foot.

7. The high-heeled shoe of claim 1, wherein, for high-heeled shoes having vertical heights ranging from two to four and a half inches, in half inch increments, with $A_1$ representing a vertical height of 2", $A_2$ representing 2½", $A_3$ representing 3", $A_4$ representing 3½", $A_5$ representing 4", and $A_6$ representing 4½", the following table comprises angular curvature at positions, as measured from a rear of the shoe, at the terminus of the heel, along the sole and wherein angular curvatures for vertical heights other than the half inch increments between the two to four and a half inches are extrapolated therefrom, and wherein the range of angular curvature values for each position $A_1$ extends from values from $A_1$ to $A_2$; for $A_2$ the angular curvature values extends from values from $A_1$ to $A_3$; for $A_3$ the angular curvature values extends from values from $A_2$ to $A_4$; for $A_4$ the angular curvature values extends from values from $A_3$ to $A_5$; and for $A_5$ the angular curvature values extends from values from $A_4$ to $A_6$; and for $A_6$ the angular curvature values extends from values from $A_4$ to $A_6$;

| | Distance Along the Insole Board from Rear of Shoe | | | | | | | | | |
|---|---|---|---|---|---|---|---|---|---|---|
| Heel Height | 90-100 mm | 80-90 mm | 70-80 mm | 60-70 mm | 50-60 mm | 40-50 mm | 30-40 mm | 20-30 mm | 10-20 mm | 0-10 mm |
| $A_1$ (2")- $A_2$(2½") | 42.96°-45.63° | 41.97°-44.02° | 38.66°-39.84° | 33.89°-34.11° | 28.43°-27.75° | 22.83°-21.42° | 17.41°-15.49° | 12.36°-10.17° | 7.78°-5.53° | 3.75°-1.59° |
| $A_2$(2½")- $A_3$ (3") | 45.63°-49.61° | 44.02°-46.92° | 39.84°-41.20° | 34.11°-33.86° | 27.75°-26.16° | 21.42°-18.93° | 15.49°-12.54° | 10.17°-7.10° | 5.53°-2.60° | 1.59°-0.27° |
| $A_3$ (3")- $A_4$(3½") | 49.61°-51.72° | 46.92°-48.40° | 41.20°-41.77° | 33.86°-33.51° | 26.16°-25.11° | 18.93°-17.46° | 12.54°-10.91° | 7.10°-5.50° | 2.60°-1.14° | 0.27°-0.00° |
| $A_4$(3½")- $A_5$ (4") | 51.72°-56.13° | 48.40°-51.32° | 41.77°-42.52° | 33.51°-32.18° | 25.11°-22.35° | 17.46°-14.03° | 10.91°-7.38° | 5.50°-2.20° | 1.14°-0.00° | 0.00°-0.00° |
| $A_5$(4")- $A_6$(4½") | 56.13°-58.43° | 51.32°-52.74° | 42.52°-42.63° | 32.18°-31.10° | 22.35°-20.60° | 14.03°-12.07° | 7.38°-5.48° | 2.20°-0.51°. | 0.00° | 0.00° |

8. The high-heeled shoe of claim 7, wherein the heel section comprises an inclination α rising from a base of the heel section and an inclination β rising from the base of the toe section wherein the value ranges for α and β for varying vertical heights are set forth in the following table:

| | Distance Along the Insole Board from Rear of Shoe | | | | | | | | | | | |
|---|---|---|---|---|---|---|---|---|---|---|---|---|
| Heel Height | 90-100 mm | 80-90 mm | 70-80 mm | 60-70 mm | 50-60 mm | 40-50 mm | 30-40 mm | 20-30 mm | 10-20 mm | 0-10 mm | Heel Angle (α) | Toe Angle (β) |
| $A_1$ (2") | 42.96° | 41.97° | 38.66° | 33.89° | 28.43° | 22.83° | 17.41° | 12.36° | 7.78° | 3.75° | 5°-9° | 7°-26° |
| $A_2$ (2½") | 45.63° | 44.02° | 39.84° | 34.11° | 27.75° | 21.42° | 15.49° | 10.17° | 5.53° | 1.59° | 12°-16° | 7°-26° |
| $A_3$ (3") | 49.61° | 46.92° | 41.20° | 33.86° | 26.16° | 18.93° | 12.54° | 7.10° | 2.60° | 0.27° | 14°-18° | 7°-26° |
| $A_4$ (3½") | 51.72° | 48.40° | 41.77° | 33.51° | 25.11° | 17.46° | 10.91° | 5.50° | 1.14° | 0.00° | 16°-20° | 7°-26° |
| $A_5$ (4") | 56.13° | 51.32° | 42.52° | 32.18° | 22.35° | 14.03° | 7.38° | 2.20° | 0.00° | 0.00° | 18°-22° | 7°-26° |
| $A_6$ (4½") | 58.43° | 52.74° | 42.63° | 31.10° | 20.60° | 12.07° | 5.48° | 0.51° | 0.00° | 0.00° | 22°-26° | 7°-26°. |

9. The high-heeled shoe of claim 1, wherein, for high-heeled shoes having vertical heights ranging from two to four and a half inches, in half inch increments, with $A_1$ representing a vertical height of 2", $A_2$ representing 2½", $A_3$ representing 3", $A_4$ representing 3½", $A_5$ representing 4", $A_6$ representing 4.5", the following table comprises angular curvature as measured from a rear of the shoe at the terminus of the heel along the sole and wherein angular curvatures for vertical heights other than the half inch increments between the two to four inches and a half inches are extrapolated therefrom:

| | Distance Along the Insole Board from Rear of Shoe | | | | | | | | | |
|---|---|---|---|---|---|---|---|---|---|---|
| Heel Height | 90-100 mm | 80-90 mm | 70-80 mm | 60-70 mm | 50-60 mm | 40-50 mm | 30-40 mm | 20-30 mm | 10-20 mm | 0-10 mm |
| $A_1$ (2")- | 42.96°- | 41.97°- | 38.66°- | 33.89°- | 28.43°- | 22.83°- | 17.41°- | 12.36°- | 7.78°- | 3.75°- |
| $A_2$(2½") | 45.63° | 44.02° | 39.84° | 34.11° | 27.75° | 21.42° | 15.49° | 10.17° | 5.53° | 1.59° |
| $A_2$(2½")- | 45.63°- | 44.02°- | 39.84°- | 34.11°- | 27.75°- | 21.42°- | 15.49°- | 10.17°- | 5.53°- | 1.59°- |
| $A_3$ (3") | 49.61° | 46.92° | 41.20° | 33.86° | 26.16° | 18.93° | 12.54° | 7.10° | 2.60° | 0.27° |
| $A_3$ (3")- | 49.61°- | 46.92°- | 41.20°- | 33.86°- | 26.16°- | 18.93°- | 12.54°- | 7.10°- | 2.60°- | 0.27°- |
| $A_4$(3½") | 51.72° | 48.40° | 41.77° | 33.51° | 25.11° | 17.46° | 10.91° | 5.50° | 1.14° | 0.00° |
| $A_4$(3½")- | 51.72°- | 48.40°- | 41.77°- | 33.51°- | 25.11°- | 17.46°- | 10.91°- | 5.50°- | 1.14°- | 0.00°- |
| $A_5$ (4") | 56.13° | 51.32° | 42.52° | 32.18° | 22.35° | 14.03° | 7.38° | 2.20° | 0.00° | 0.00° |
| $A_5$(4")- | 56.13°- | 51.32°- | 42.52°- | 32.18°- | 22.35°- | 14.03°- | 7.38°- | 2.20°- | 0.00° | 0.00° |
| $A_6$(4½") | 58.43° | 52.74° | 42.63° | 31.10° | 20.60° | 12.07° | 5.48° | 0.51°. | | |

10. A high-heeled shoe for a human foot which enables a human to assume and maintain anatomically suitable body posture for standing and walking, the high-heeled shoe comprising a toe section and a heel section separated by and connected with a sole section, the high-heeled shoe being configured for the respective support of a toe, heel and sole of a human foot wherein a vertical distance between support of the toe and support of the heel is between two to four and a half inches and wherein the sole section which is adapted to directly support a human sole and heel for high-heeled shoes having vertical heights ranging from two to four and a half inches, in half inch increments, with $A_1$ representing a vertical height of 2", $A_2$ representing 2½", $A_3$ representing 3", $A_4$ representing 3½", $A_5$ representing 4", and $A_6$ representing 4½", with the following table comprising angular curvature at positions, as measured from a rear of the shoe, at the terminus of the heel, along the sole and wherein angular curvatures for vertical heights other than the half inch increments between the two to four and a half inches are extrapolated therefrom, and wherein the range of angular curvature values for each position $A_1$ extends from values from $A_1$ to $A_2$; for $A_2$ the angular curvature values extends from values from $A_1$ to $A_3$; for $A_3$ the angular curvature values extends from values from $A_2$ to $A_4$; for $A_4$ the angular curvature values extends from values from $A_3$ to $A_5$; and for $A_5$ the angular curvature values extends from values from $A_4$ to $A_6$; and for $A_6$ the annular curvature values extends from values from $A_5$ to $A_6$;

| | Distance Along the Insole Board from Rear of Shoe | | | | | | | | | |
|---|---|---|---|---|---|---|---|---|---|---|
| Heel Height | 90-100 mm | 80-90 mm | 70-80 mm | 60-70 mm | 50-60 mm | 40-50 mm | 30-40 mm | 20-30 mm | 10-20 mm | 0-10 mm |
| $A_1$ (2")- | 42.96°- | 41.97°- | 38.66°- | 33.89°- | 28.43°- | 22.83°- | 17.41°- | 12.36°- | 7.78°- | 3.75°- |
| $A_2$(2½") | 45.63° | 44.02° | 39.84° | 34.11° | 27.75° | 21.42° | 15.49° | 10.17° | 5.53° | 1.59° |
| $A_2$(2½")- | 45.63°- | 44.02°- | 39.84°- | 34.11°- | 27.75°- | 21.42°- | 15.49°- | 10.17°- | 5.53°- | 1.59°- |
| $A_3$ (3") | 49.61° | 46.92° | 41.20° | 33.86° | 26.16° | 18.93° | 12.54° | 7.10° | 2.60° | 0.27° |
| $A_3$ (3")- | 49.61°- | 46.92°- | 41.20°- | 33.86°- | 26.16°- | 18.93°- | 12.54°- | 7.10°- | 2.60°- | 0.27°- |
| $A_4$(3½") | 51.72° | 48.40° | 41.77° | 33.51° | 25.11° | 17.46° | 10.91° | 5.50° | 1.14° | 0.00° |
| $A_4$(3½")- | 51.72°- | 48.40°- | 41.77°- | 33.51°- | 25.11°- | 17.46°- | 10.91°- | 5.50°- | 1.14°- | 0.00°- |
| $A_5$ (4") | 56.13° | 51.32° | 42.52° | 32.18° | 22.35° | 14.03° | 7.38° | 2.20° | 0.00° | 0.00° |
| $A_5$(4")- | 56.13°- | 51.32°- | 42.52°- | 32.18°- | 22.35°- | 14.03°- | 7.38°- | 2.20°- | 0.00° | 0.00° |
| $A_6$(4½") | 58.43° | 52.74° | 42.63° | 31.10° | 20.60° | 12.07° | 5.48° | 0.51°. | | |

* * * * *